US011001978B2

(12) United States Patent
Nishino et al.

(10) Patent No.: US 11,001,978 B2
(45) Date of Patent: May 11, 2021

(54) CONCRETE STRUCTURE

(71) Applicant: SUMITOMO ELECTRIC INDUSTRIES, LTD., Osaka (JP)

(72) Inventors: Motonobu Nishino, Osaka (JP); Masato Yamada, Osaka (JP); Yoshiyuki Matsubara, Osaka (JP); Katsuhito Oshima, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/627,874

(22) PCT Filed: Feb. 26, 2018

(86) PCT No.: PCT/JP2018/006953

§ 371 (c)(1),
(2) Date: Dec. 31, 2019

(87) PCT Pub. No.: WO2019/021516

PCT Pub. Date: Jan. 31, 2019

(65) Prior Publication Data

US 2020/0123719 A1 Apr. 23, 2020

(30) Foreign Application Priority Data

Jul. 28, 2017 (JP) ..... JP2017-145953

(51) Int. Cl.
*E01D 19/12* (2006.01)
*E01D 101/26* (2006.01)

(52) U.S. Cl.
CPC ..... *E01D 19/125* (2013.01); *E01D 2101/268* (2013.01)

(58) Field of Classification Search
CPC ..... E01D 19/125; E01D 2101/268; E01D 2101/285
(Continued)

(56) References Cited

U.S. PATENT DOCUMENTS 3,022,713 A * 2/1962 Friberg ..... E04C 5/125 264/34
3,237,537 A * 3/1966 Hutchings ..... E01C 7/16 404/70
(Continued)

FOREIGN PATENT DOCUMENTS

JP S53-84317 A 7/1978
JP 2003-56121 A 2/2003
(Continued)

OTHER PUBLICATIONS

Apr. 24, 2018 Search Report issued in International Patent Application No. PCT/JP2018/006953.

*Primary Examiner* — Raymond W Addie
(74) *Attorney, Agent, or Firm* — Oliff PLC

(57) ABSTRACT

A concrete structure includes a first concrete member, a second concrete member, a sheath that is disposed in a through hole extending from the first concrete member to the second concrete member, a tension part that is inserted over the entire length of the sheath and that is subjected to a tensile force, a fixing tool that fixes the tension part to the first concrete member or the second concrete member, and an anticorrosion part that covers the fixing tool. The tension part includes a stranded wire part and a first cover that covers an outer periphery of the stranded wire part. A space between the sheath and the tension part is not filled with a grout material.

11 Claims, 4 Drawing Sheets

(58) Field of Classification Search
USPC ..... 404/6, 17, 47–75; 14/73, 77.1, 78
See application file for complete search history.

(56) References Cited

U.S. PATENT DOCUMENTS 3,656,690 A * 4/1972 Hanig ..... E01B 29/005 238/2
4,125,580 A * 11/1978 Lippert ..... E01C 7/16 264/228
4,245,923 A * 1/1981 Rieve ..... E01C 7/16 264/229
6,588,160 B1 7/2003 Grossman
7,144,187 B1 * 12/2006 Nolte ..... E01F 15/083 404/6
7,296,317 B2 * 11/2007 Grace ..... E01D 2/04 14/73
7,475,446 B1 * 1/2009 He ..... E01D 2/02 14/73
8,316,495 B2 * 11/2012 He ..... E04B 5/04 14/77.1
9,009,899 B2 * 4/2015 Schnitzler ..... E01D 19/14 14/22
2007/0180634 A1 * 8/2007 Grace ..... E01D 2/04 14/73
2016/0115658 A1 * 4/2016 Annan ..... E04C 5/122 14/21

FOREIGN PATENT DOCUMENTS

JP 2007-277742 A 10/2007
JP 2015-25330 A 2/2015
JP 2015-151768 A 8/2015
JP 2016-98490 A 5/2016

* cited by examiner

CONCRETE STRUCTURE

TECHNICAL FIELD

The present invention relates to a concrete structure.

This application claims priority based on Japanese Patent Application No. 2017-145953 filed on Jul. 28, 2017, the entire contents of which are incorporated herein by reference.

BACKGROUND ART

A precast concrete block, which is a concrete member, can be used as, for example, a floor slab of a bridge. As a method of constructing a floor slab of a bridge, a method in which a plurality of precast-concrete (PC) floor slabs are disposed side by side on a steel beam and a tension part continuously inserted into the plurality of PC floor slabs is used to introduce a compressive stress to the PC floor slabs is known (refer to, for example, PTL 1 and PTL 2).

CITATION LIST

Patent Literature

PTL 1: Japanese Unexamined Patent Application Publication No. 2016-98490

PTL 2: Japanese Unexamined Patent Application Publication No. 2015-151768

SUMMARY OF INVENTION

A concrete structure according to the present invention is a concrete structure in which a plurality of concrete members are disposed side by side and are connected to each other. The concrete structure includes a first concrete member that is disposed on one end portion; a second concrete member that is disposed on another end portion; a sheath that is disposed inside a through hole extending through the plurality of concrete members from the first concrete member to the second concrete member so that the sheath covers a wall surface surrounding the through hole; a tension part that is inserted over an entire length of the sheath so that an end part region is exposed from two ends of the sheath, and that is subjected to a tensile force in a longitudinal direction; a fixing tool that fixes the end part region of the tension part that is exposed from the sheath to the first concrete member or the second concrete member; and an anticorrosion part that covers the fixing tool. The tension part includes a stranded wire part in which a plurality of steel wires are stranded, and a first cover layer that covers an outer periphery of the stranded wire part. A space between the sheath and the tension part is not filled with a grout material.

DESCRIPTION OF EMBODIMENTS

Figure 1:
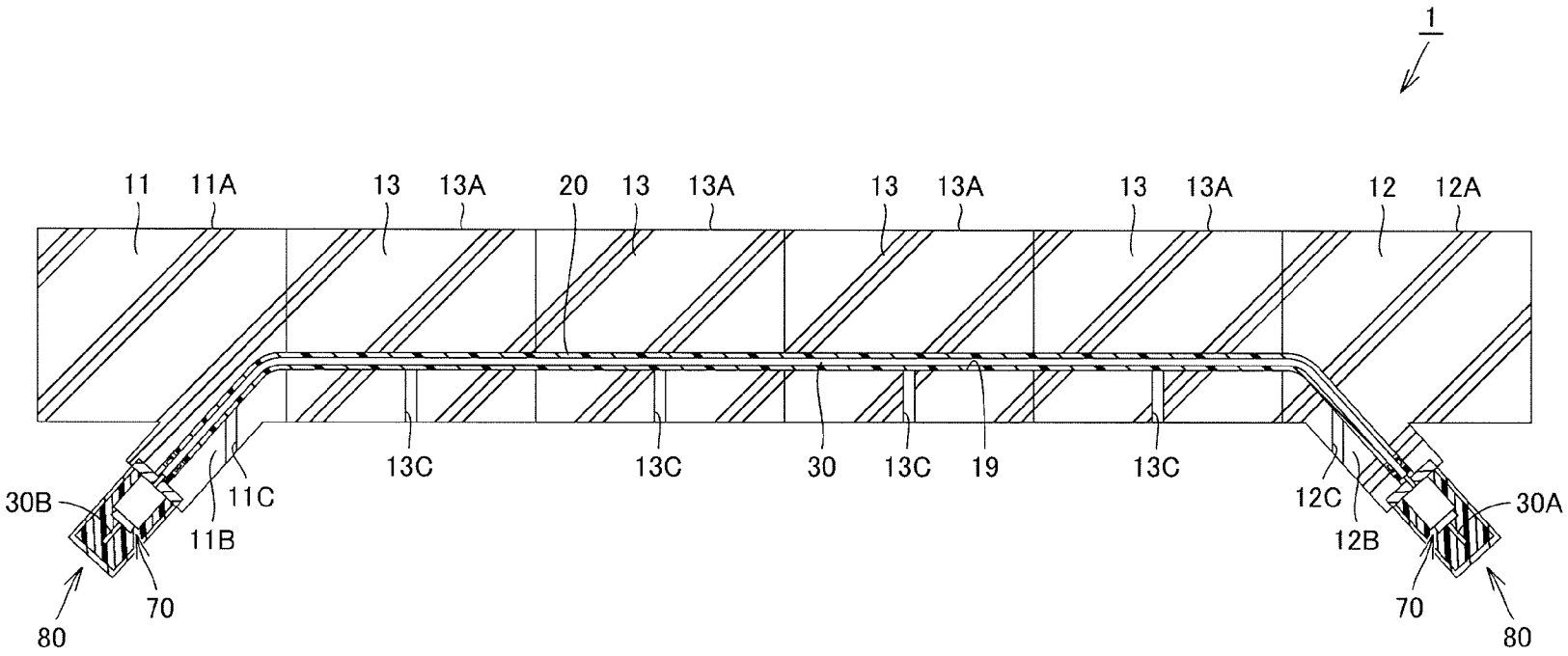
FIG. 1 is a schematic sectional view showing a structure of a concrete structure.

Problems to be Solved by Present Disclosure

When the structures disclosed in PTL 1 and PTL 2 above are used, the tension part is inserted into the sheath embedded in the PC floor slabs. The space between the sheath and the tension part is filled with a grout material. This causes the tensioned tension part and the PC floor slabs to be integrated with each other.

However, when such structures are used and some PC floor slabs among the plurality of PC floor slabs are to be exchanged, it is difficult to remove the tension of the tension part. Therefore, it becomes troublesome to perform the operations for exchanging some PC floor slabs. In recent years, while elevated roads and bridges that have existed for a long time from the start of common use of the elevated roads and the bridges are required to be updated on a large scale, the elevated roads and the bridges that are to be updated or new elevated roads and new bridges that are to be constructed in the future are required to be easily repairable.

Accordingly, one object is to make it easy to exchange some of a plurality of concrete members while introducing a compressive stress in a concrete structure in which the plurality of concrete members are disposed side by side and are connected to each other.

Advantageous Effects of Present Disclosure

According to the concrete structure above, in the concrete structure in which a plurality of concrete members are disposed side by side and are connected to each other, it is possible to easily exchange some concrete members while introducing a compressive stress.

Description of Embodiments of Present Invention

First, specific forms of the present invention are enumerated and described. A concrete structure according to one form of the present invention is a concrete structure in which a plurality of concrete members are disposed side by side and are connected to each other. The concrete structure includes a first concrete member that is disposed on one end portion; a second concrete member that is disposed on another end portion; a sheath that is disposed inside a through hole extending through the plurality of concrete members from the first concrete member to the second concrete member so that the sheath covers a wall surface surrounding the through hole; a tension part that is inserted over an entire length of the sheath so that an end part region is exposed from two ends of the sheath, and that is subjected to a tensile force in a longitudinal direction; a fixing tool that fixes the end part region of the tension part that is exposed from the sheath to the first concrete member or the second concrete member; and an anticorrosion part that covers the fixing tool. The tension part includes a stranded wire part in which a plurality of steel wires are stranded, and a first cover layer that covers an outer periphery of the stranded wire part. A space between the sheath and the tension part is not filled with a grout material.

In the concrete structure according to the one form of the present invention, the space between the sheath and the tension part is not filled with a grout material. In other words, the space is filled with air. Therefore, in the concrete structure of the present invention, integration between the concrete members and the tension part is in a stoppable state.

Consequently, if the anticorrosion part and the fixing tool are removed, the tension of the tension part is removed. As a result, it is easy to exchange some concrete members. The tension part has a structure in which the stranded wire part is covered by the first cover layer. Therefore, even if the space between the sheath and the tension part is not filled with a grout material, corrosion of the stranded wire part is suppressed from occurring. In this way, according to the concrete structure of the present invention, in the concrete structure in which a plurality of concrete members are disposed side by side and are connected to each other, it is possible to easily exchange some concrete members while introducing a compressive stress.

In the concrete structure above, a communication path may be formed in at least one of the plurality of concrete members, the communication path allowing an outside of the concrete member and an inside of the sheath to communicate with each other. Therefore, even if, for example, moisture has entered the space between the sheath and the tension part, it is possible to discharge the moisture via the communication path. The communication path is desirably formed downward from a horizontal direction, and is more desirably formed in a vertical direction. This makes it possible to effectively discharge the moisture that has entered the space.

In the concrete structure above, the sheath may include a plurality of sheath units that have a tubular shape, that are disposed side by side in the longitudinal direction, and that are connected to each other, and a connecting member that connects the sheath units that are adjacent to each other. In addition, a gap between the sheath units that are adjacent to each other and the communication path may communicate with each other. This makes it possible to easily realize a structure in which the inside of the sheath and the communication path communicate with each other.

In the concrete structure above, the connecting member may include a communication part that allows the gap and the communication path to communicate with each other. In addition, the communication part of the connecting member may be disposed inside the communication path of the concrete member. This makes it possible to easily realize a structure in which the inside of the sheath and the communication path communicate with each other.

In the concrete structure above, the first cover layer may be made of epoxy resin.

As the material of which the first cover layer is made, epoxy resin is suitable. Epoxy resin excels in anticorrosion property, wear resistance, compression resistance, and adhesiveness with steel wires, and can further suppress corrosion of the stranded wire part from occurring.

In the concrete structure above, the tension part may further include a second cover layer that surrounds an outer peripheral side of the first cover layer and that is made of a material that differs from a material of the first cover layer. This makes it possible to more reliably suppress corrosion of the stranded wire part from occurring.

In the concrete structure above, the second cover layer may be made of polyethylene.

As the material of which the second cover layer is made, polyethylene is suitable. Since polyethylene excels in weather resistance, it is possible to further increase anticorrosion and to further suppress corrosion of the stranded wire part.

In the concrete structure above, the tension part may further include an oil layer that is disposed between the first cover layer and the second cover layer. This makes it possible to more reliably suppress corrosion of the stranded wire part from occurring.

In the concrete structure above, the fixing tool may restrain the end part region so as to be in contact with the first cover layer. This makes it possible for the fixing tool to more reliably restrain the tension part.

In the concrete structure above, the anticorrosion part may include a cover part that is made of a disassemblable resin and that covers the fixing tool. This makes it easy to remove the cover part when exchanging the concrete members. In the present invention, "disassemblable resin" refers to a resin that, though having a strength that allows it to be independent and prevents it from undergoing natural disintegration, has a strength that allows it to be broken into pieces by a human being.

Details of Embodiments of Present Invention

Next, an embodiment of a concrete structure according to the present invention is described below with reference to the drawings. In the drawings below, the same or equivalent parts are given the same reference numerals and their descriptions are not repeated.

1. Floor Slab Structure

Referring to FIG. 1, a floor slab structure 1 for an elevated road, which is a concrete structure in the present embodiment, has a structure in which PC floor slabs, which are a plurality of concrete members, are disposed side by side and are connected to each other.

The floor slab structure 1 includes a first end part floor slab 11 that serves as a first concrete member and that is disposed on one end portion, a second end part floor slab 12 that serves as a second concrete member and that is disposed on another end portion, and a plurality of intermediate floor slabs 13 (here, four intermediate floor slabs 13) that are disposed between the first end part floor slab 11 and the second end part floor slab 12. The first end part floor slab 11, the second end part floor slab 12, and the intermediate floor slabs 13 are PC floor slabs that are obtained by pouring concrete having fluidity into a mold having a desired shape and solidifying the concrete.

Each intermediate floor slab 13 has, for example, a rectangular parallelepiped shape. The first end part floor slab 11 has, for example, a shape in which a first protruding part 11B protrudes from a rectangular parallelepiped main body part. The second end part floor slab 12 has, for example, a shape in which a second protruding part 12B protrudes from a rectangular parallelepiped main body part. The first end part floor slab 11 has a first travel surface 11A. The second end part floor slab 12 has a second travel surface 12A. Each intermediate floor slab 13 has an intermediate travel surface 13A. The first end part floor slab 11, the second end part floor slab 12, and the intermediate floor slabs 13 are disposed side by side so that the first travel surface 11A, the second travel surface 12A, and the intermediate travel surfaces 13A are flush with each other. The first travel surface 11A, the second travel surface 12A, and the intermediate travel surfaces 13A correspond to road-surface-side surfaces along which, for example, vehicles travel. The first protruding part 11B protrudes from a surface on a side opposite to the first travel surface 11A. The second protruding part 12B protrudes from a surface on a side opposite to the second travel surface 12A. The first protruding part 11B protrudes away from the intermediate floor slabs 13 with decreasing distance from an end. The second protruding part 12B protrudes away from the intermediate floor slabs 13 with decreasing distance from an end.

2. Sheath

The floor slab structure 1 further includes a sheath 20 that is disposed inside a through hole 19 extending from the first end part floor slab 11 to the second end part floor slab 12 via the plurality of intermediate floor slabs 13 so as to cover a wall surface surrounding the through hole 19. The sheath 20 is made of a resin, such as polyethylene, and has a hollow cylindrical shape. The sheath 20 extends in the direction of the intermediate travel surfaces 13A inside the intermediate floor slabs 13. When the sheath 20 enters the first end part floor slab 11 and the second end part floor slab 12, the sheath 20 is bent so as to extend in the protruding direction of the first protruding part 11B and the protruding direction of the second protruding part 12B. Inside the first protruding part 11B and the second protruding part 12B, the sheath 20 extends in the direction of the first protruding part 11B and in the direction of the second protruding part 12B.

A first end part floor slab communication path 11C that allows an outside of the first end part floor slab 11 and an inside of the sheath 20 to communicate with each other is formed in the first end part floor slab 11. The first end part floor slab communication path 11C is formed in the first protruding part 11B. In a state in which the floor slab structure 1 is installed, the first end part floor slab communication path 11C extends in a vertical direction. A second end part floor slab communication path 12C that allows an outside of the second end part floor slab 12 and the inside of the sheath 20 to communicate with each other is formed in the second end part floor slab 12. The second end part floor slab communication path 12C is formed in the second protruding part 12B. In the state in which the floor slab structure 1 is installed, the second end part floor slab communication path 12C extends in the vertical direction. Each intermediate floor slab communication path 13C that allows an outside of its corresponding intermediate floor slab 13 and the inside of the sheath 20 to communicate with each other is formed in its corresponding intermediate floor slab 13. In the state in which the floor slab structure 1 is installed, each intermediate floor slab communication path 13C extends in the vertical direction.

Figure 2:
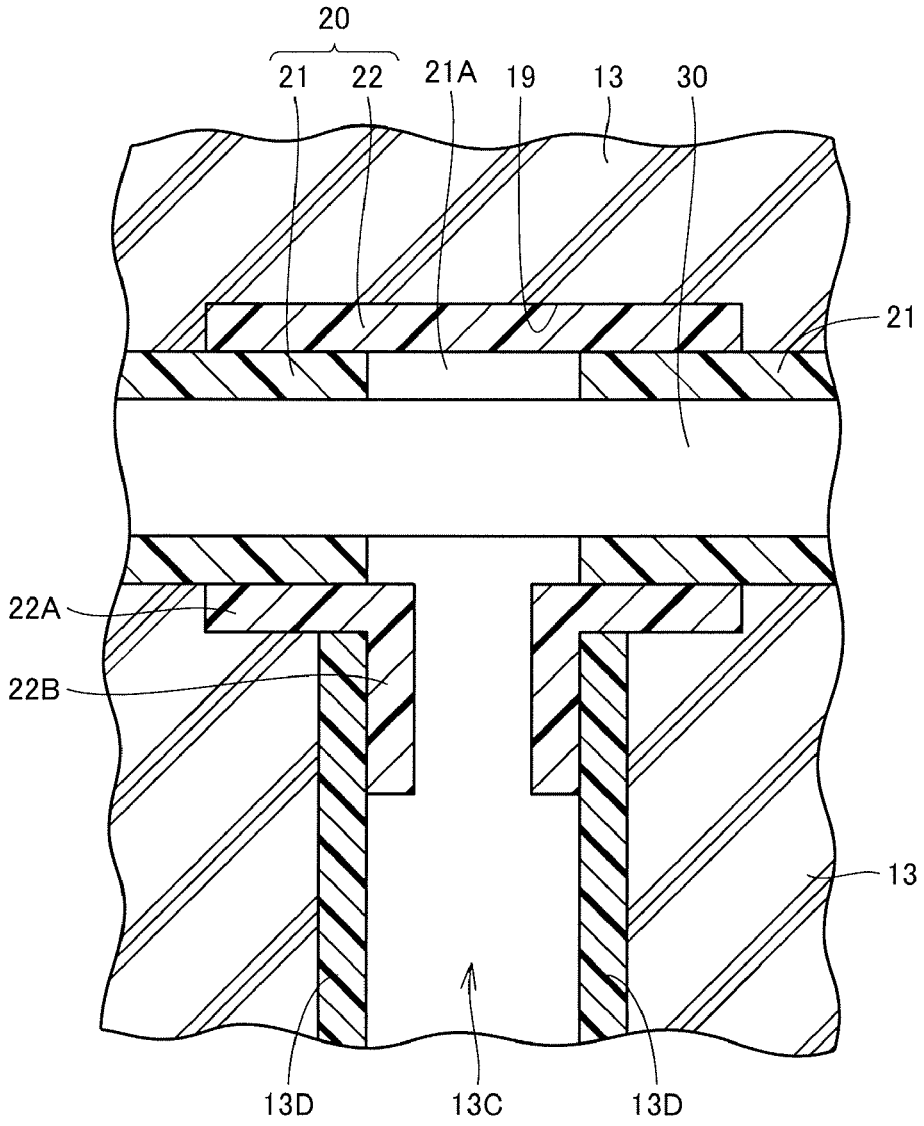
FIG. 2 is a schematic sectional view showing a structure of a sheath and a communication path.

FIG. 2 is an enlarged view showing a region where one intermediate floor slab communication path 13C and the inside of the sheath 20 communicate with each other. Hereunder, although the region where one intermediate floor slab communication path 13C and the sheath 20 communicate with each other is described, a region where the first end part floor slab communication path 11C and the sheath 20 communicate with each other and a region where the second end part floor slab communication path 12C and the sheath 20 communicate with each other also have the same structure.

Referring to FIG. 2, the sheath 20 includes a plurality of sheath units 21 that have a tubular shape, more specifically, a hollow cylindrical shape, and that are disposed side by side in a longitudinal direction, and a connecting member 22 that connects the sheath units 21 that are adjacent to each other. The connecting member 22 includes a main body part 22A that has a hollow cylindrical shape and a communication part 22B that protrudes in a direction (vertical direction) intersecting an axial direction of the main body part 22A. The inside diameter of the main body part 22A has a dimension corresponding to the outside diameter of each sheath unit 21. By inserting end portions of the adjacent sheath units 21 into the main body part 22A so as to be fitted thereto, the adjacent sheath units 21 are connected to each other by the connecting member 22. By disposing the communication part 22B inside the communication path 13C, a gap between the adjacent sheath units 21 (constituting a part of a space 21A) and the communication path 13C communicate with each other.

More specifically, a hose 13D that has, for example, a tubular shape, more specifically, a hollow cylindrical shape and that is made of a resin is disposed so as to cover a wall surface of the intermediate floor slab 13 surrounding the communication path 13C. The inside diameter of the hose 13D has a dimension corresponding to the outside diameter of the communication part 22B. By inserting the communication part 22B into the hose 13D so as to be fitted thereto, the hose 13D and the communication part 22B are connected to each other.

3. Tension Part

Figure 3:
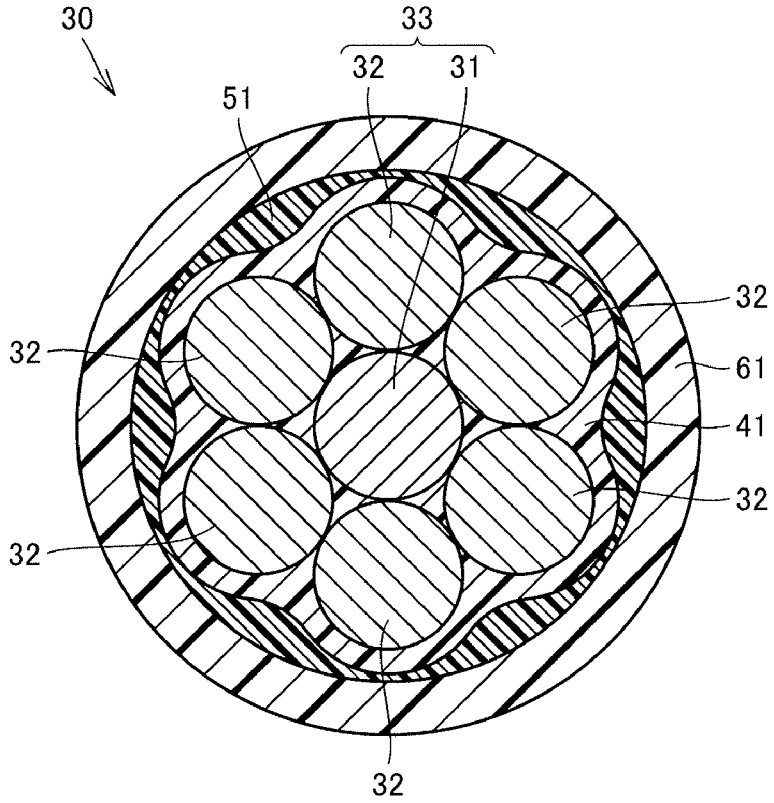
FIG. 3 is a schematic sectional view showing a structure of a tension part.

Referring to FIG. 1, the floor slab structure 1 further includes a tension part 30 that is inserted over the entire length of the sheath 20 so that an end part region 30A and an end part region 30B are exposed from respective ends of the sheath 20, and that is subjected to a tensile force in the longitudinal direction. Referring to FIGS. 1 and 2, the space 21A is formed between the main body part 22A of the connecting member 22 and the tension part 30. The space 21A also extends between the sheath units 21 and the tension part 30. The space 21A between the sheath 20 and the tension part 30 is not filled with a grout material. That is, the space 21A is filled with air. FIG. 3 shows a cross section of the tension part 30 perpendicular to the longitudinal direction. Referring to FIG. 3, the tension part 30 includes a stranded wire part 33 in which a plurality of steel wires 31 and 32 are stranded, a first cover layer 41 that covers an outer periphery of the stranded wire part 33, a second cover layer 61 that surrounds an outer peripheral side of the first cover layer 41, and an oil layer 51 that is disposed between the first cover layer 41 and the second cover layer 61.

The stranded wire part 33 includes a core wire 31 that is a steel wire and a plurality of periphery wires 32 (here, six periphery wires 32) that are steel wires. The periphery wires 32 are in contact with an outer peripheral surface of the core wire 31 and are disposed so as to surround the outer peripheral surface of the core wire 31. The cross sections, which are perpendicular to the longitudinal direction, of the core wire 31 and the periphery wires 32 are circular.

The first cover layer 41 surrounds the stranded wire part 33 and fills a gap in the stranded wire part 33 (a region that is interposed between the outer peripheral surface of the core wire 31 and an outer peripheral surface of each periphery wire 32). The first cover layer 41 is made of, for example, epoxy resin. The second cover layer 61 is made of a material that differs from the material of the first cover layer 41. The second cover layer 61 is made of, for example, polyethylene, more specifically, high-density polyethylene. The second cover layer 61 has a tubular shape, for example, a hollow cylindrical shape. The oil layer 51 fills a space between the first cover layer 41 and the second cover layer 61. The oil layer 51 is made of, for example, wax.

4. Fixing Tool and Anticorrosion Part

Figure 4:
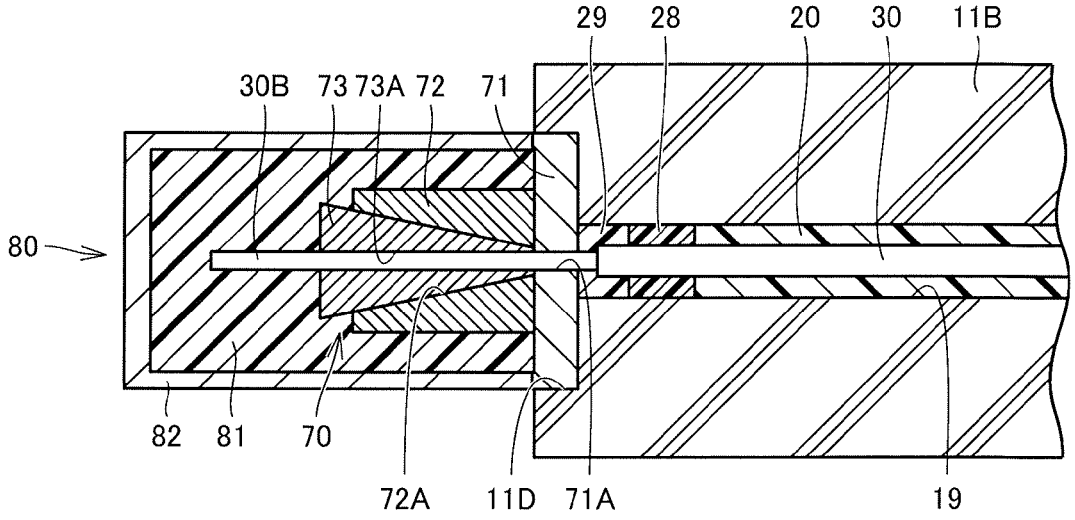
FIG. 4 is a schematic sectional view showing a structure of a fixing tool and an anticorrosion part.
Figure 5:
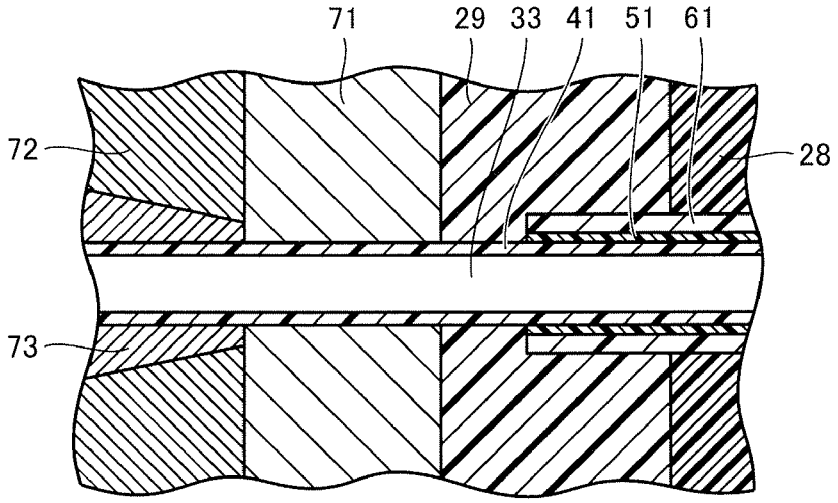
FIG. 5 is a schematic sectional view showing a structure of the vicinity of the fixing tool.

Referring to FIG. 1, the floor slab structure 1 further includes a fixing tool 70 that fixes the end part region 30B of the tension part 30 that is exposed from the sheath 20 to the first end part floor slab 11, a fixing tool 70 that fixes the end part region 30A to the second end part floor slab 12, and anticorrosion parts 80 and 80 that cover the respective fixing tools 70. FIG. 4 is a schematic sectional view showing a structure of one fixing tool 70 and one anticorrosion part 80 that are installed on the first end part floor slab 11. FIG. 5 is a schematic sectional view showing in enlarged form a structure of the vicinity of the one fixing tool 70. Although, the structure of the fixing tool 70 and the anticorrosion part 80 that are installed on the first end part floor slab 11 is described, the fixing tool 70 and the anticorrosion part 80 that are installed on the second end part floor slab 12 also have the same structure.

Referring to FIG. 4, the fixing tool 70 includes a supporting plate 71, a grip 72, and a wedge member 73. For example, a disk-shaped concave part 11D is formed in an end surface of the first protruding part 11B. The supporting plate 71 having a disk shape corresponding to the shape of the concave part 11D is fitted and installed inside the concave part 11D. A through hole 71A extending through a central portion of the supporting plate 71 in a thickness direction is formed in the supporting plate 71. The supporting plate 71 is made of a metal, such as steel. The grip 72 has, for example, a cylindrical shape, and is made of a metal, such as steel. The grip 72 is disposed so that one end surface thereof is in contact with an end surface of the supporting plate 71 on a side opposite to the side that is in contact with the first protruding part 11B. A frusto-conical through hole 72A whose central axis coincides with the central axis of the grip 72 is formed in the grip 72. The through hole 72A has a tapering shape whose diameter becomes smaller towards the supporting plate 71.

The wedge member 73 has a frusto-conical shape corresponding to the shape of the through hole 72A of the grip 72 and includes a plurality of members in which a metal member having a through hole 73A formed in a region including the central axis is divided in a peripheral direction by cutting the metal member by a plane including the central axis. The wedge member 73 is fitted and disposed with respect to the grip 72 so that its outer peripheral surface is in contact with an inner wall surface that surrounds the through hole 72A of the grip 72. The supporting plate 71, the grip 72, and the wedge member 73 are disposed such that their central axes coincide with each other. The end part region 30B of the tension part 30 extends through the through hole 71A of the supporting plate 71 and the through hole of the wedge member 73.

The anticorrosion part 80 includes a cap 82 that covers the fixing tool 70 and the end part region 30B of the tension part 30 protruding from the fixing tool 70, and a cover part 81 that covers the fixing tool 70 so as to fill a space between the cap 82 and the fixing tool 70. The cap 82 has a shape in which one end of a hollow cylinder is closed by a wall part and the other end is open. By bringing an open-side end of the cap 82 into contact with the supporting plate 71, the cap 82 covers the fixing tool 70 and the end part region 30B of the tension part 30 protruding from the fixing tool 70. The cover part 81 is made of, for example, a disassemblable resin. As the disassemblable resin, for example, "disassemblable resin 4441J" or "disassemblable resin 8882", manufactured by Sumitomo 3M Limited, may be used.

Referring to FIGS. 4 and 5, the fixing tool 70 restrains the end part region 30B of the tension part 30 so as to be in contact with the first cover layer 41. More specifically, in the end part region 30B, the second cover layer 61 and the oil layer 51 of the tension part 30 are removed and the first cover layer 41 is in an exposed state. With an outer peripheral surface of the first cover layer 41 and the wedge member 73 in contact with each other, the end part region 30B of the tension part 30 is restrained by the fixing tool 70.

Referring to FIG. 4, in the through hole 19 of the first end part floor slab 11, a fluid-tight member 28 is disposed in a region between an end surface of the sheath 20 and the supporting plate 71 so as to be in contact with the end surface of the sheath 20. The fluid-tight member 28 is, for example, a member primarily made of rubber and having a through hole through which the tension part 30 extends. The fluid-tight member 28 is in contact with the second cover layer 61 of the tension part 30. That is, a boundary between a region of the tension part 30 where the second cover layer 61 and the oil layer 51 have been removed and a region of the tension part 30 where the second cover layer 61 and the oil layer 51 have not been removed is positioned in a space between the fluid-tight member 28 and the supporting plate 71. The space between the fluid-tight member 28 and the supporting plate 71 is filled with a resin part 29. The resin part 29 is made of the same material as the cover part 81, such as a disassemblable resin. The resin part 29 is formed when, at the time of forming the cover part 81, uncured resin enters the through hole 19 via a slight gap of the fixing tool 70. The fluid-tight member 28 has the functions of ensuring the fluid-tightness between the tension part 30 and the wall surface of the first end part floor slab 11 surrounding the through hole 19 and of suppressing the uncured resin from entering the sheath 20.

5. Advantageous Effects of Floor Slab Structure

In a structure in which a compressive force is applied to the concrete members by a tensile force of the tension part inserted into the sheath, in general, the space between the sheath and the tension part is filled with a grout material. In contrast, in the floor slab structure 1 of the present embodiment, the space 21A between the sheath 20 and the tension part 30 is not filled with a grout material. In other words, the space 21A is filled with air. Therefore, in the floor slab structure 1, integration of the first end part floor slab 11, the second end part floor slab 12, and the intermediate floor slabs 13, which constitute the floor slab structure 1, with the tension part 30 is in a stoppable state. Consequently, if the anticorrosion parts 80 and the fixing tools 70 are removed, the tension of the tension part 30 is removed. In particular, in the present embodiment, the cover part 81 of each anticorrosion part 80 is made of a disassemblable resin. As a result, it is easy to exchange some of the floor slabs 11, 12, and 13.

In the present embodiment, the tension part 30 has a structure in which the stranded wire part 33 is covered by the first cover layer 41, the oil layer 51, and the second cover layer 61. Therefore, even if the space 21A between the sheath 20 and the tension part 30 is not filled with a grout material, it is possible to suppress corrosion of the stranded wire part 33 from occurring. In this way, the floor slab structure 1 of the present embodiment is such that, in the structure in which the plurality of floor slabs 11, 12, 13 are disposed side by side and are connected to each other, it is easy to exchange some of the floor slabs 11, 12, and 13 while introducing a compressive stress.

In the present embodiment, the communication paths 11C, 12C, and 13C, each allowing the outside of a corresponding one of the floor slabs 11, 12, and 13 and the inside of the sheath 20 to communicate with each other, are formed in a corresponding one of the plurality of floor slabs 11, 12, and 13. Although the communication paths 11C, 12C, and 13C need not be formed, by forming the communication paths 11C, 12C, and 13C, even if, for example, moisture has entered the space between the sheath 20 and the tension part 30, it is possible to discharge the moisture via the communication paths 11C, 12C, and 13C.

6. Method of Manufacturing Floor Slab Structure (Constructing Procedure)

Next, a general description of a constructing procedure of the floor slab structure 1 is given. Referring to FIGS. 1 to 5, in constructing the floor slab structure 1 in the present embodiment, first, the first end part floor slab 11, the second end part floor slab 12, and the intermediate floor slabs 13 are prepared. The first end part floor slab 11, the second end part floor slab 12, and the intermediate floor slabs 13 can be prepared by, with the sheath 20 (the sheath units 21 and the connecting members 22) disposed in a mold having a desired shape, pouring concrete having fluidity and solidifying the concrete.

Next, the prepared first end part floor slab 11, the prepared second end part floor slab 12, and the prepared intermediate floor slabs 13 are disposed side by side on, for example, an already installed steel beam. At this time, the floor slabs 11, 12, and 13 are disposed so that portions of the sheath 20 inside the floor slabs 11, 12, and 13 that are adjacent to each other are connected to each other.

Next, the tension part 30 is inserted over the entire length of the sheath 20 so that the end part region 30A and the end part region 30B are exposed from the two ends of the sheath 20. The oil layer 51 and the second cover layer 61 on two end portions of the tension part 30 are removed. The fluid-tight member 28 is disposed in contact with two end surfaces of the sheath 20. A pair of the supporting plate 71 and the grip 72 and another pair of the supporting plate 71 and the grip 72 are disposed at a portion of the first end part floor slab 11 and at a portion of the second end part floor slab 12, respectively, the portions corresponding to two exits of the through hole 19. Thereafter, by using, for example, a tensile force applying device, such as a jack, a tensile force (a tensile stress) in the longitudinal direction is applied to the tension part 30. With the application of the tensile force by the tensile force applying device being maintained, each wedge member 73 is pushed into a space between the grip 72 and the tension part 30. When the application of the tensile force by the tensile force applying device is stopped, the tension part 30 tries to shrink. However, the tension part 30 is prevented from shrinking by being restrained by the wedge members 73 and the grips 72, and the tensile force is maintained. The tensile force gives rise to a state in which a compressive stress is applied to the floor slab structure 1.

Next, after covering the fixing tools 70 with the respective caps 82, a disassemblable resin having fluidity is introduced from a through hole (not shown) in each cap 82. The introduced disassemblable resin fills the space between the fixing tools 70 and the respective caps 82 and enters the space between the fluid-tight member 28 in the through hole 19 and each supporting plate 71. Thereafter, due to the passage of time, the disassemblable resin is solidified and becomes the cover parts 81 and the resin part 29. By performing the procedure above, the floor slab structure 1 of the present embodiment can be constructed.

The embodiment disclosed herein is illustrative in all respects and should be understood as being non-limitative in any perspective. The scope of the present invention is defined by the claims rather than by the description above. The scope of the present invention is intended to embrace all changes within the meaning and range of equivalency of the claims.

REFERENCE SIGNS LIST

1 floor slab structure
11 first end part floor slab
11A first travel surface
11B first protruding part
11C first end part floor slab communication path
11D concave part
12 second end part floor slab
12A second travel surface
12B second protruding part
12C second end part floor slab communication path
13 intermediate floor slab
13A intermediate travel surface
13C intermediate floor slab communication path
13D hose
19 through hole
20 sheath
21 sheath unit
21A space
22 connecting member
22A main body part
22B communication part
28 fluid-tight member
29 resin part
30 tension part
30A end part region
30B end part region
31 core wire
32 periphery wire
33 stranded wire part
41 first cover layer
51 oil layer
61 second cover layer
70 fixing tool
71 supporting plate
71A through hole
72 grip
72A through hole
73 wedge member
73A through hole
80 anticorrosion part
81 cover part
82 cap

The invention claimed is:

1. A concrete structure in which a plurality of concrete members are disposed side by side and are connected to each other, the concrete structure comprising:

a first concrete member that is disposed on one end portion of the concrete structure;

a second concrete member that is disposed on another end portion of the concrete structure;

a sheath that is disposed inside a through hole extending through the plurality of concrete members from the first concrete member to the second concrete member so that the sheath covers a wall surface surrounding the through hole;

a tension part that is inserted into the sheath over an entire length of the sheath so that an end part region of the tension part is exposed from two ends of the sheath, and that is subjected to a tensile force in a longitudinal direction of the tension part;

a fixing tool that fixes the end part region of the tension part that is exposed from the sheath to the first concrete member or the second concrete member; and an anticorrosion part that covers the fixing tool, wherein the tension part includes:

a stranded wire part in which a plurality of steel wires are stranded, and a first cover layer that covers an outer periphery of the stranded wire part, wherein a space between the sheath and the tension part is not filled with a grout material, and wherein a communication path is formed in at least one concrete member of the plurality of concrete members, the communication path allowing an outside of the at least one concrete member and an inside of the sheath to communicate with each other.

2. The concrete structure according to claim 1, wherein the sheath includes:

a plurality of sheath units that have a tubular shape, that are disposed side by side in the longitudinal direction, and that are connected to each other, and a connecting member that connects the sheath units that are adjacent to each other, and wherein a gap between the sheath units that are adjacent to each other and the communication path communicate with each other.

3. The concrete structure according to claim 2, wherein the connecting member includes a communication part that allows the gap and the communication path to communicate with each other, and wherein the communication part is disposed inside the communication path.

4. The concrete structure according to claim 1, wherein the first cover layer is made of epoxy resin.

5. The concrete structure according to claim 1, wherein the tension part further includes a second cover layer that surrounds an outer peripheral side of the first cover layer and that is made of a material that differs from a material of the first cover layer.

6. The concrete structure according to claim 5, wherein the second cover layer is made of polyethylene.

7. The concrete structure according to claim 5, wherein the tension part further includes an oil layer that is disposed between the first cover layer and the second cover layer.

8. The concrete structure according to claim 1, wherein the fixing tool restrains the end part region so as to be in contact with the first cover layer.

9. The concrete structure according to claim 1, wherein the anticorrosion part includes a cover part that is made of a disassemblable resin and that covers the fixing tool.

10. A concrete structure in which a plurality of concrete members are disposed side by side and are connected to each other, the concrete structure comprising:

a first concrete member that is disposed on one end portion of the concrete structure;

a second concrete member that is disposed on another end portion of the concrete structure;

a sheath that is disposed inside a through hole extending through the plurality of concrete members from the first concrete member to the second concrete member so that the sheath covers a wall surface surrounding the through hole;

a tension part that is inserted into the sheath over an entire length of the sheath so that an end part region of the tension part is exposed from two ends of the sheath, and that is subjected to a tensile force in a longitudinal direction of the tension part;

a fixing tool that fixes the end part region of the tension part that is exposed from the sheath to the first concrete member or the second concrete member; and an anticorrosion part that covers the fixing tool, wherein the tension part includes:

a stranded wire part in which a plurality of steel wires are stranded, a first cover layer that covers an outer periphery of the stranded wire part, and a second cover layer that surrounds an outer peripheral side of the first cover layer and that is made of a material that differs from a material of the first cover layer, wherein the second cover layer is made of polyethylene, and wherein a space between the sheath and the tension part is not filled with a grout material.

11. A concrete structure in which a plurality of concrete members are disposed side by side and are connected to each other, the concrete structure comprising:

a first concrete member that is disposed on one end portion of the concrete structure;

a second concrete member that is disposed on another end portion of the concrete structure;

a sheath that is disposed inside a through hole extending through the plurality of concrete members from the first concrete member to the second concrete member so that the sheath covers a wall surface surrounding the through hole;

a tension part that is inserted into the sheath over an entire length of the sheath so that an end part region of the tension part is exposed from two ends of the sheath, and that is subjected to a tensile force in a longitudinal direction of the tension part;

a fixing tool that fixes the end part region of the tension part that is exposed from the sheath to the first concrete member or the second concrete member; and an anticorrosion part that covers the fixing tool, wherein the tension part includes:

a stranded wire part in which a plurality of steel wires are stranded, a first cover layer that covers an outer periphery of the stranded wire part, a second cover layer that surrounds an outer peripheral side of the first cover layer and that is made of a material that differs from a material of the first cover layer, and an oil layer that is disposed between the first cover layer and the second cover layer, and wherein a space between the sheath and the tension part is not filled with a grout material.

* * * * *